US005426810A

United States Patent [19]

Rones

[11] Patent Number: 5,426,810

[45] Date of Patent: Jun. 27, 1995

[54] ABRASIVE PAD HOLDER

[75] Inventor: James Rones, Acworth, Ga.

[73] Assignee: Americo, Acworth, Ga.

[21] Appl. No.: 247,555

[22] Filed: May 23, 1994

[51] Int. Cl.[6] ..... A47L 17/08

[52] U.S. Cl. ..... 15/229.13; 15/145; 15/147.2; 15/209.1; D32/51

[58] Field of Search ..... 15/143.1, 145, 147.2, 15/209.1, 210.1, 228, 229.11, 229.13, 231, 232, 236.07, 236.08, 244.1; 30/322, 169; 81/119, 177.1, 186; 294/7, 55, 55.5; D32/35, 40, 46, 49, 51, 52

[56] References Cited

U.S. PATENT DOCUMENTS

| | | | |
|---|---|---|---|
| 72,306 | 12/1867 | Leas | 15/47.2 |
| D. 156,039 | 11/1949 | Sabo | D32/51 |
| D. 198,742 | 7/1964 | Bennett | D32/51 |
| D. 276,561 | 11/1984 | Belcher | D32/35 |
| 315,814 | 4/1885 | Morgan | D32/51 |
| 825,400 | 7/1906 | Lightbown | 15/231 |
| 825,401 | 7/1906 | Merckens | 81/177.1 |
| 1,241,307 | 9/1917 | Tompkins | 15/236.08 |
| 1,367,293 | 2/1921 | Brandes | 15/147.2 |
| 2,603,999 | 7/1952 | Boutte | 81/119 |
| 2,679,064 | 5/1954 | Palma, Jr. et al. | 15/244.1 |
| 2,774,983 | 12/1956 | Crowther | 15/121 |
| 2,820,236 | 1/1958 | Crowther | 15/229.13 |
| 3,041,651 | 7/1962 | Jardine | 15/244.1 |
| 3,239,866 | 3/1966 | Czerniawski | 15/231 |
| 3,571,837 | 3/1971 | Weaver | 15/231 |
| 3,800,354 | 4/1974 | Stephens | 15/104.04 |
| 5,012,594 | 5/1991 | Verry | 15/231 |

FOREIGN PATENT DOCUMENTS

| | | | |
|---|---|---|---|
| 272270 | 3/1914 | Germany | 81/119 |
| 2306779 | 8/1974 | Germany | 81/119 |
| 331623 | 7/1930 | United Kingdom | 15/228 |

*Primary Examiner*—Mark Spisich
*Attorney, Agent, or Firm*—Sughrue, Mion, Zinn, Macpeak & Seas

[57] ABSTRACT

A pad holder for holding a rough abrasive pad includes a flat disk-like portion having an elongated slot extending inwardly from an edge thereof, a handle portion disposed at an angle relative to the disk-like portion and an intermediate connecting portion. The handle portion, the connecting portion and the disk portion may be of one piece molded plastic construction. The pad holding slot is provided with outwardly flared edges at the entrance to the slot, a narrow neck portion and a wide interior end portion to facilitate the entry of a folded pad and the retention of the folded pad therein.

3 Claims, 1 Drawing Sheet

ABRASIVE PAD HOLDER

BACKGROUND OF THE INVENTION

The present invention is directed to an abrasive pad holder and more specifically to a pad holder having an elongated handle and an offset portion with a tapered slot into which a folded abrasive pad may be inserted and held during a scrubbing operation.

It is well known that scrubbing pads comprised of steel wool or other metallic material are not only abrasive with respect to the pots and pans which they are designed to clean but are also very abrasive to a user's hands. In an effort to protect the hands of a user, various holding devices have been devised over the years for abrasive pads.

Most abrasive pad holders are generally comprised of a substantially U-shaped clamping member adapted to have the abrasive pad disposed within the bight of the U-shaped member. Upon gripping the pad holder, the pad will be gripped between the sides of the U-shaped member during a scrubbing operation. Examples of such pad holders are shown in the U.S. patent to Stephens (U.S. Pat. No. 1,895,496) and the U.S. patent to Trevellyan (U.S. Pat. No. 2,109,404).

Other types of pad holders utilize an elongated handle with clamping means at one end for holding a steel wool pad for scouring pots and pans. An example of such a scouring device is disclosed in the U.S. patent to Grossman (U.S. Pat. No. 3,783,467). However, such a pad holder, being substantially flat and planar, does not expose a pad in the optimum position for effective scrubbing and the clamping device at the end is readily susceptible to breakage.

SUMMARY OF THE INVENTION

The present invention is directed to a new and improved abrasive pad holder which has a simple rugged construction without any flexible members which would be susceptible to breakage and which is provided with an elongated handle and offset pad holding portion to dispose the abrasive pad in an optimum position for the effective scrubbing of pots and pans and the like.

The present invention provides a new and improved abrasive pad holder comprised of an elongated handle member having a flat pad holder portion disposed parallel thereto but offset therefrom at one end with an elongated slot in the plane of the pad holder portion having an angled entry portion followed by a constrictive neck and a gradually enlarged area in the direction of the handle.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
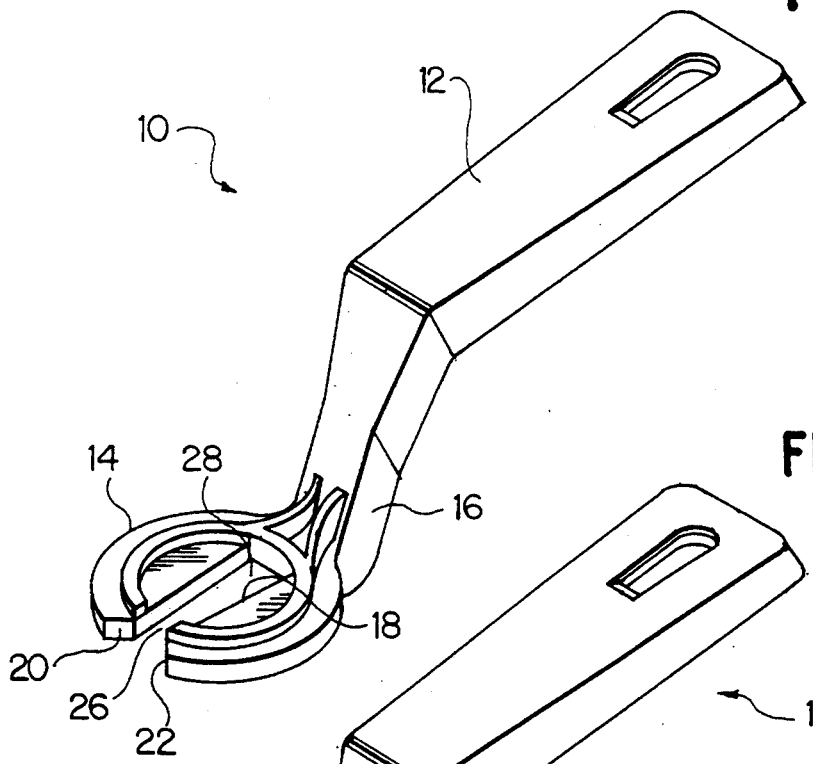
FIG. 1 is a perspective view of the abrasive pad holder without an abrasive pad.

The pad holder 10 shown in FIG. 1 is comprised of an elongated handle portion 12, a flat disk-shaped pad holder 14 and an offset connector portion 16 of one piece plastic molded construction. Suitable reinforcing ribs may be provided on the underside of the handle and connecting portion as well as about the circumference of the pad holder to strengthen the assembly.

The pad holder portion 14 has an elongated slot 18 extending in the direction of the handle 12 and is open at the end thereof remote from the connector portion 16. The side edges 20 and 22 of the slot adjacent the open end are outwardly flared to facilitate the insertion of a folded steel wool pad 24. The slot is provided with a narrow neck portion 26 and then the side edges of the slot 18 diverge to provide a wide main portion 28.

Figure 2:
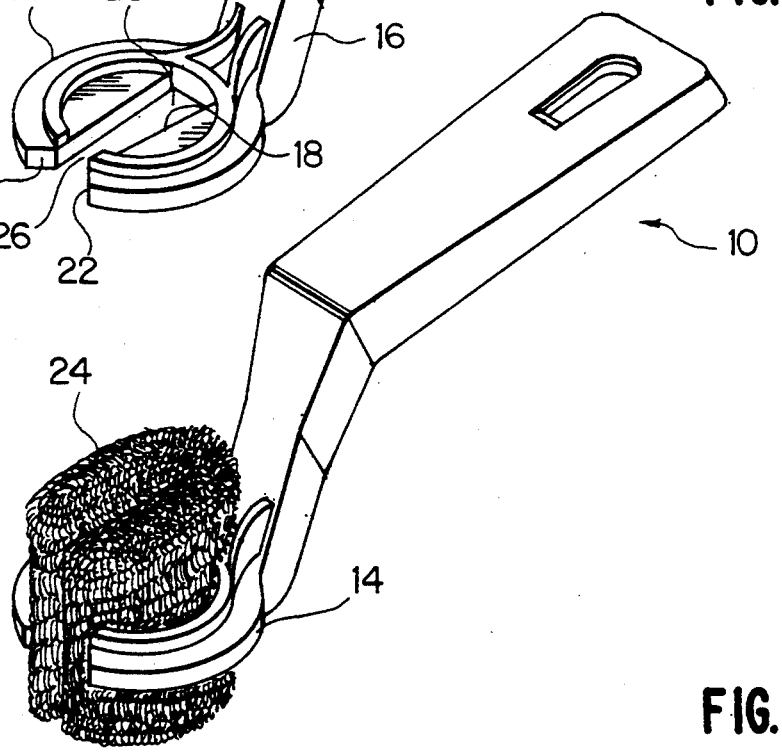
FIG. 2 is a perspective view similar to FIG. 1 with a folded abrasive pad secured therein.
Figure 3:
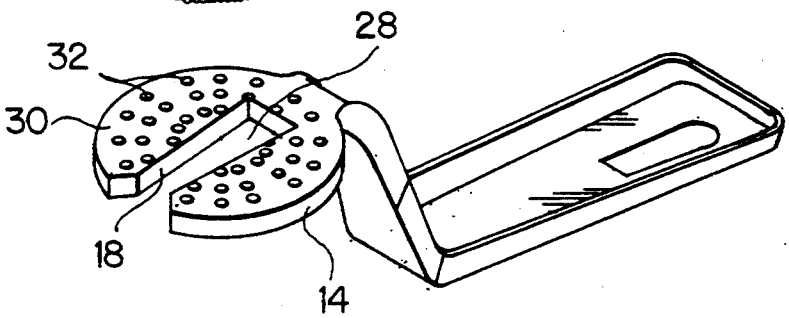
FIG. 3 is a perspective view of the underside of the pad holder.

As shown in FIG. 2, the steel wool pad 24 or any other type of scrubbing pad is then folded and inserted into the slot 18 where the pad will be securely held during a subsequent scrubbing operation. During scrubbing, the portion of the pad below the holder portion 14 tends to flatten out against the under surface of the holder portion 14 and a plurality of raised projections 32 are provided on the under surface of the holder portion 14 which will press into the flattened pad portion to hold the pad against movement relative to the holding portion 14.

The pad holder 10 can be formed of any suitable material and can be formed from a plurality of separate components which are secured together by any suitable means. However, it is preferable to mold the entire pad holder as a one piece plastic holder. The exact angles between the handle 12, the offset connector portion 16 and the pad holding portion 14 may vary but are preferably on the order as shown in the drawings wherein a handle portion 12 is disposed at an angle between 10 and 40 degrees relative to the pad holding portion 14.

While the invention has been particularly shown and described with reference to preferred embodiments thereof, it will be understood by those in the art that the foregoing and other changes in form and details may be made therein without departing from the spirit and scope of the invention.

What is claimed is:

1. A pad holder comprising a flat pad-holding disk portion, an upstanding connector portion connected at one end thereof to said disk portion adjacent an edge thereof and an elongated handle portion connected to an opposite end of said connector portion and extending in a substantially opposite direction relative to said disk portion, wherein said disk portion is provided with an elongated slot aligned with said handle portion and extending from a point adjacent said connector portion to an opening at a point on an edge of the holding disk portion and wherein said slot is provided with a wide end portion adjacent said connector portion, outwardly flared end edges defining the opening and an intermediate portion with the slot having a width at the intermediate portion less than at the wide-end portion and the opening.

2. A pad holder as set forth in claim 1, wherein said handle portion has a longitudinal axis disposed at an angle between 10°–40 ° with a plane parallel to said flat pad holding portion.

3. A pad holder as set forth in claim 1, wherein said pad holding disk portion is provided with an undersurface having a plurality of pad-gripping projections extending therefrom.

* * * * *